US011585183B2

(12) United States Patent
Hosie et al.

(10) Patent No.: US 11,585,183 B2
(45) Date of Patent: Feb. 21, 2023

(54) ANNULUS ISOLATION DEVICE

(71) Applicant: Baker Hughes Energy Technology UK Limited, Bristol (GB)

(72) Inventors: Stanley Hosie, Katy, TX (US); Lee Stanley Hosie, Katy, TX (US)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 17/590,963

(22) Filed: Feb. 2, 2022

(65) Prior Publication Data

US 2022/0243549 A1 Aug. 4, 2022

Related U.S. Application Data

(60) Provisional application No. 63/145,220, filed on Feb. 3, 2021.

(51) Int. Cl.

| | |
|---|---|
| ***E21B 33/043*** | (2006.01) |
| ***E21B 33/035*** | (2006.01) |
| ***B63G 8/00*** | (2006.01) |
| ***E21B 34/04*** | (2006.01) |

(52) U.S. Cl.

CPC ..... *E21B 33/043* (2013.01); *B63G 8/001* (2013.01); *E21B 33/035* (2013.01); *E21B 34/04* (2013.01); *B63G 2008/005* (2013.01)

(58) Field of Classification Search

CPC ..... E21B 33/043; E21B 33/035; E21B 34/04; B63G 2008/005; B63G 8/001

See application file for complete search history.

(56) References Cited

U.S. PATENT DOCUMENTS 4,328,866 A * 5/1982 Zimmerman ..... E21B 34/063 166/317
4,333,526 A * 6/1982 Watkins ..... E21B 34/02 166/72
4,869,318 A 9/1989 Kellett
(Continued)

FOREIGN PATENT DOCUMENTS

| | | |
|---|---|---|
| GB | 2 342 668 | 4/2000 |
| WO | 01/73256 | 10/2001 |
| WO | 2008/137340 | 11/2008 |

OTHER PUBLICATIONS

International Search Report and Written Opinion dated May 16, 2022 in corresponding PCT Application No. PCT/EP2022/025039.
Baker Hughes, "Subsea 101," 2020, 16 pages.

*Primary Examiner* — Aaron L Lembo
(74) *Attorney, Agent, or Firm* — Hogan Lovells US LLP

(57) ABSTRACT

A wellbore system includes a tubing hanger positioned within a wellhead and a Christmas tree (XT) coupled to the tubing hanger. The wellbore system also includes an annulus isolation device (AID). The AID includes a manual actuator configured to drive a wedge in a linear direction. The AID also includes a mating wedge arranged within an annulus flow path, the mating wedge configured to receive a force responsive to movement of the wedge. The AID further includes a stab coupled to the mating wedge, the stab configured to move in an axially downward direction responsive to movement of the mating wedge, the stab having a slotted portion moveable into alignment with an annulus passage to permit flow into the annulus flow path.

20 Claims, 3 Drawing Sheets

(56) References Cited

U.S. PATENT DOCUMENTS

| | | | | | |
|---|---|---|---|---|---|
| 5,465,794 | A * | 11/1995 | McConaughy | E21B 33/047 | 166/382 |
| 6,076,605 | A * | 6/2000 | Lilley | E21B 33/035 | 166/344 |
| 6,186,237 | B1 * | 2/2001 | Voss, Jr. | E21B 33/047 | 166/348 |
| 6,681,850 | B2 | 1/2004 | Bartlett | | |
| 7,121,344 | B2 * | 10/2006 | Fenton | E21B 33/035 | 166/386 |
| 7,670,485 | B2 | 3/2010 | Fenton | | |
| 8,240,389 | B2 * | 8/2012 | Christie | E21B 33/043 | 166/368 |
| 8,464,795 | B2 * | 6/2013 | Dyson | E21B 33/043 | 137/496 |
| 9,249,647 | B2 | 2/2016 | Kobe | | |
| 9,945,202 | B1 * | 4/2018 | June | E21B 33/0407 | |
| 10,161,244 | B2 | 12/2018 | Taylor | | |
| 10,900,314 | B2 * | 1/2021 | Randle | E21B 17/05 | |
| 2002/0000322 | A1 * | 1/2002 | Bartlett | E21B 33/043 | 166/368 |
| 2015/0191994 | A1 | 7/2015 | Kobe | | |
| 2018/0187513 | A1 | 7/2018 | Lundheim | | |

* cited by examiner

ANNULUS ISOLATION DEVICE

CROSS REFERENCE TO RELATED APPLICATIONS

This application claims priority to and the benefit of U.S. Provisional Patent Application Ser. No. 63/145,220 filed Feb. 3, 2021 titled "ANNULUS ISOLATION DEVICE," the full disclosure of which is hereby incorporated herein by reference in its entirety for all purposes.

BACKGROUND

1. Field of Disclosure

This disclosure relates in general to oil and gas tools, and in particular, to systems and methods for annulus isolation devices.

2. Description of the Prior Art

In exploration and production of formation minerals, such as oil and gas, wellbores may be drilled into an underground formation. The wellbores may be cased wellbores where a casing or tubular string is positioned against a wall of the borehole, where cement may be injected to secure the casing string to the formation. Hangers may be arranged within the wellbore, such as tubing hangers, where production tubing may be suspended for production, injection, or recovery. However, access to an annulus may be desirable, which may lead to using auxiliary equipment.

SUMMARY

Applicants recognized the problems noted above herein and conceived and developed embodiments of systems and methods, according to the present disclosure, for wellbore operations.

In an embodiment, a wellbore system includes a tubing hanger positioned within a wellhead and a Christmas tree (XT) coupled to the tubing hanger. The wellbore system also includes an annulus isolation device (AID) associated with the tubing hanger, wherein at least a portion of the AID extends through the XT and at least a portion extends through the tubing hanger. The AID includes a manual actuator configured to drive a wedge in a linear direction. The AID also includes a mating wedge arranged within an annulus flow path, the mating wedge configured to receive a force responsive to movement of the wedge. The AID further includes a stab coupled to the mating wedge, the stab configured to move in an axially downward direction responsive to movement of the mating wedge, the stab having a slotted portion moveable into alignment with an annulus passage formed in the tubing hanger to permit flow into the annulus flow path.

In an embodiment, a wellbore system includes a tubing hanger positioned within a wellhead. The wellbore system also includes a Christmas tree (XT) coupled to the tubing hanger. The wellbore system further includes an annulus isolation device (AID) associated with the tubing hanger, wherein at least a portion of the AID extends through the XT and at least a portion extends through the tubing hanger. The AID includes an activation system, the activation system configured to convert a linear force into an axial force. The AID also includes a first stab portion extending through at least a portion of the XT. The AID further includes a second stab portion extending through at least a portion of the tubing hanger, the second stab portion including at least one opening fluidly coupled to an internal bore. The wellbore system also includes a cap positioned within the tubing hanger, the cap having an annulus passage to fluidly couple an annulus to an annulus flow path extending through the XT and the tubing hanger.

In another embodiment, a method includes positioning a stab within both a Christmas Tree (XT) and a tubing hanger. The method also includes applying a linear force to at least a portion of the stab. The method further includes causing the linear force to be converted into an axial force to drive the stab in a downward direction. The method includes moving, responsive to the axial force, a slotted portion of the stab into alignment with an annulus flow passage, wherein the slotted portion is fluidly coupled to an annulus flow path extending through the stab.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
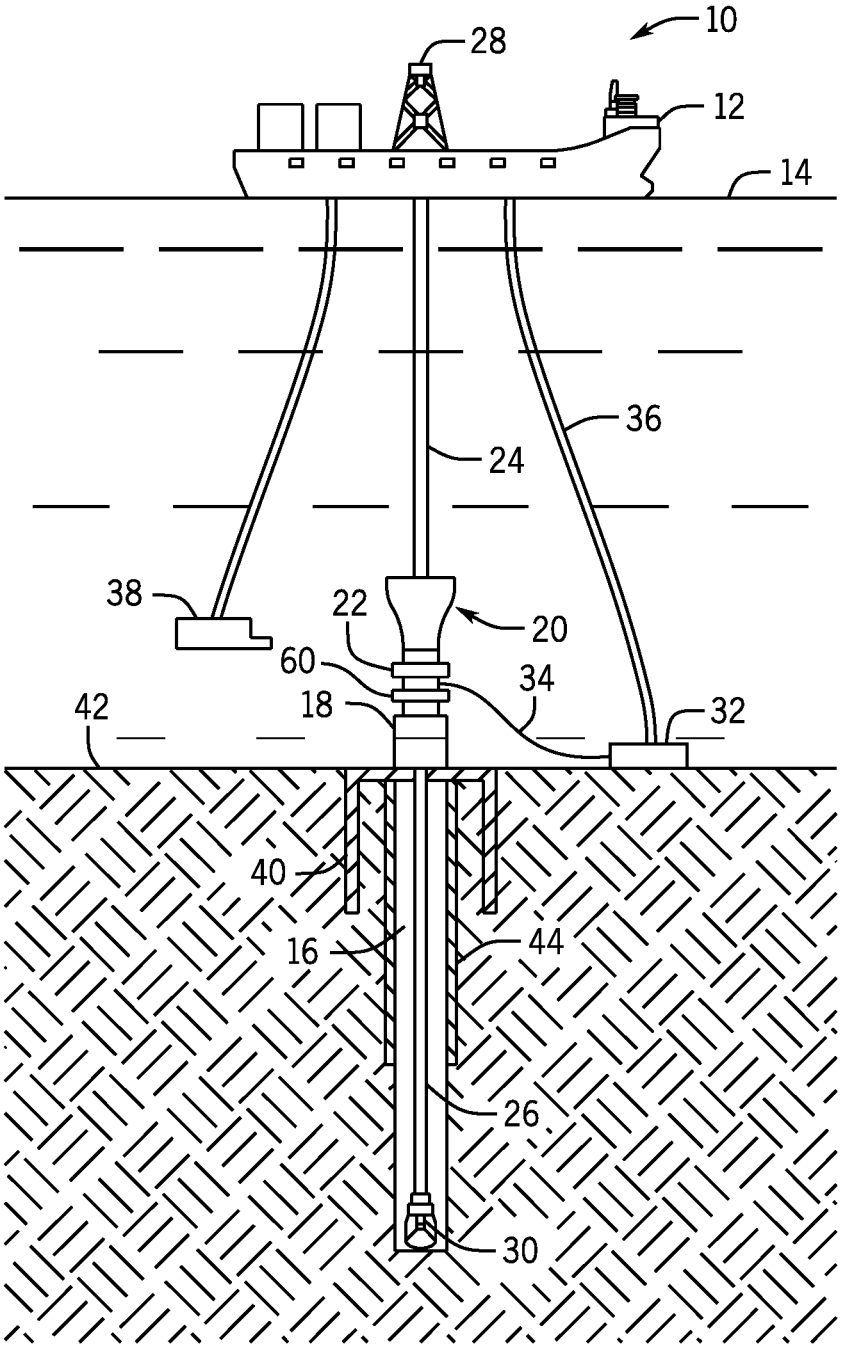
FIG. 1 is a schematic side view of an embodiment of a subsea drilling operation, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward a mechanically movable annulus stab for a tree on a wellhead. The mechanically movable annulus stab may enable translation between an isolated annulus and an accessible annulus, which would enable both flow and monitoring through the annulus. In various embodiments, the movable stab may utilize a mechanical operator, such as a 2" manual valve actuator (e.g., a rotary operator) that may be operated after a Christmas tree (XT) is landed onto a tubing hanger and locked on top of a wellhead. In various embodiments, the coupling and/or seal between the XT and the wellhead may be checked prior to operation of the annulus stab. In various embodiments, the operator may be operable via a remotely operated vehicle (ROV), for example for a subsea well, to move the stab in a vertical direction to extend or retract the embodiment's position within the well. This movement of the stab may open or allow the annulus isolation device in the tubing hanger to close and seal. In various embodiments, the annulus isolation device may consist of a spring closed sleeve that has seals on an outer diameter that seal with a slotted portion in the tubing hanger to either close or open communication with the annulus below the tubing hanger.

Embodiments of the present disclosure provide for an annulus isolation device that is mechanically opened or closed, as opposed to traditional solutions that utilize hydraulic operators. Furthermore, embodiments may include a pressure balanced design so that movement of the stab is not impacted by annulus or tree cavity pressure. Additionally, various embodiments provide for closing and testing of the annulus isolation device prior to removal of the XT.

Various embodiments are directed toward systems and methods to address problems with existing systems. Presently, annulus isolation devices are typically hydraulically operated so additional components are needed, which adds complexity to the system. These additional components are necessary due to the thermal expansion of the operation fluid on high temperature wells. Present hydraulically operated systems include hydraulic ports at a top of a tubing hanger, which limits a number of ports/functions available for downhole operations. For example, many systems require multi-porting in the hanger body, which populate available space in the tubing hanger. Furthermore, existing systems may not enable operation of the annulus isolation device prior to removal of the XT.

Embodiments of the present disclosure may overcome one or more problems with existing units. For example, thermal expansion effects are eliminated by having a mechanical operator as opposed to an hydraulic one. Furthermore, embodiments maximize space for down hole lines by having only one port, in various embodiments, but it should be appreciated that more ports may be incorporated into different configurations. Furthermore, embodiments relate to maximizing space for down hole lines, and by using the mechanical operator within the cylindrical design, provides various combinations of additional desired downhole functionality. Accordingly, components to address fluid thermal expansion effects may be eliminated and downhole function/line capacity may be increased.

FIG. 1 is a schematic side view of an embodiment of a subsea drilling operation 10. The drilling operation includes a vessel 12 floating on the sea surface 14 (e.g., a surface location) substantially above a wellbore 16. It should be appreciated that a subsea well is shown for illustrative purposes only and that various embodiments of the present disclosure may also be utilized with surface wells. A wellhead housing 18 sits at the top of the wellbore 16 and is connected to a blowout preventer (BOP) assembly 20. In the illustrated embodiment, the BOP assembly 20 is arranged above a Christmas tree (XT) 22 (e.g., production tree). The XT 22 may include valves, spools, fittings, instrumentation, and so on. The BOP assembly 20 is connected to the vessel 12 by a drilling riser 24. During drilling operations, a drill string 26 passes from a rig 28 on the vessel 12, through the riser 24, through the BOP assembly 20, through the wellhead housing 18, and into the wellbore 16. At the lower end of the drill string 26 is attached a drill bit 30 that extends the wellbore 16 as the drill string 26 turns. Additional features shown in FIG. 1 include a mud pump 32 with mud lines 34 connecting the mud pump 32 to the BOP assembly 20, and a mud return line 36 connecting the mud pump 32 to the vessel 12. A remotely operated vehicle (ROV) 38 can be used to make adjustments to, repair, or replace equipment as necessary. Although a BOP assembly 20 is shown in the figures, the XT 22 can also be attached to other well equipment, including, for example, a spool, a manifold, or another valve or completion assembly.

One efficient way to start drilling the wellbore 16 is through use of a suction pile 40. Such a procedure is accomplished by attaching the wellhead housing 18 to the top of the suction pile 40 and lowering the suction pile 40 to a sea floor 42. As interior chambers in the suction pile 40 are evacuated, the suction pile 40 is driven into the sea floor 42, as shown in FIG. 1, until the suction pile 40 is substantially submerged in the sea floor 42 and the wellhead housing 18 is positioned at the sea floor 42 so that the BOP assembly 20 can be deployed and further drilling can commence. As the wellbore 16 is drilled, the walls of the wellbore are reinforced with casings and concrete 44 to provide stability to the wellbore 16 and help to control pressure from the formation. It should be appreciated that while embodiments of the present disclosure are described with reference to subsea operations, embodiments of the present disclosure may be utilized with surface drilling operations.

Figure 2:
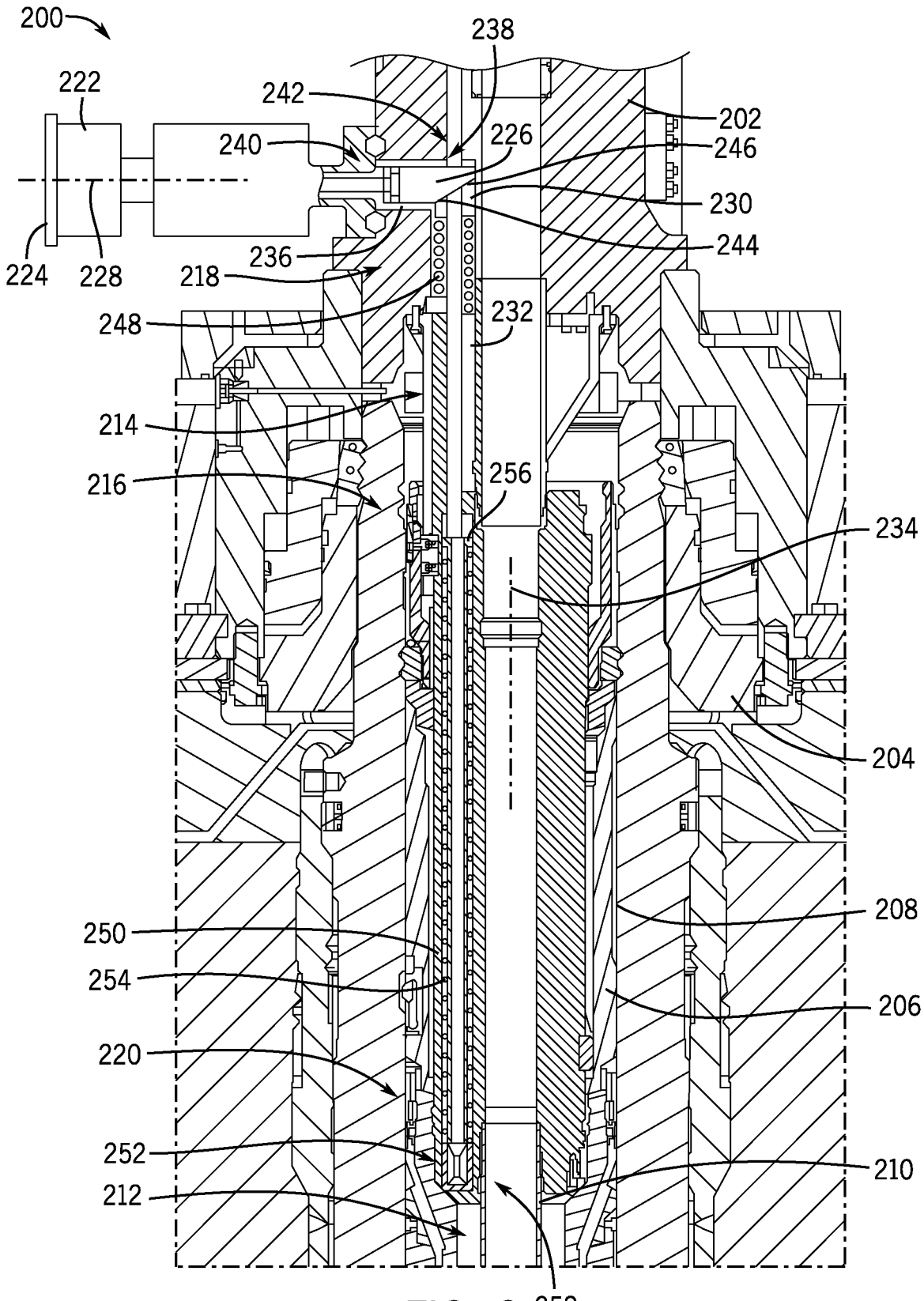
FIG. 2 is a schematic cross-sectional view of an embodiment of a wellbore system, in accordance with embodiments of the present disclosure.

FIG. 2 is a schematic cross-sectional view of an embodiment of a wellhead system 200 that includes an XT 202 coupled to a wellhead 204. The illustrated wellhead further includes a tubing hanger 206 arranged within a bore 208 with tubing 210 extending into the wellbore. An annulus 212 is formed around the tubing 210 and fluidly coupled to an annulus flow path 214 formed in the tubing hanger 206. In various embodiments, it may be desirable to receive flow and/or inject flow through the annulus flow path 214. However, it may also be desirable to block or otherwise prevent flow through the annulus flow path 214. Accordingly, embodiments of the present disclosure include an annulus isolation device (AID) 216 that may be utilized to block and/or permit flow through the annulus flow path 214.

In this example, the AID 216 is formed from a first component set 218 that is arranged in the XT 202 and a second component set 220 that is arranged within the tubing hanger 206. Accordingly, in various embodiments, the AID 216 may not be operational until the XT 202 is landed on the wellhead 204. That is, the system may be configured such that the AID 216 blocks flow in the annulus when the XT 202 is not coupled to the wellhead 204. It should be appreciated that one or more components of the first component set 218 and/or the second component set 220 may be arranged in the other of the XT 202 and/or the tubing hanger 206 and the configurations of FIG. 2 are for illustrative purposes.

Turning to the first component set 218, the illustrated AID 216 includes a manual actuator 222 (e.g., manual valve, mechanical operator, etc.) that may include a power screw, worm gear, or similar. The manual actuator 222 includes an interface 224 that may be operable using a direct contact, such as via an ROV. Accordingly, in this example, additional components such as hydraulic fluid lines may be removed from the system, thereby reducing complexity and providing further ports/functions for other wellhead operations. In various embodiments, the ROV engages the interface 224 which drives linear movement of a wedge 226 along an actuator axis 228. It should be appreciated that various other components may be utilized, for example the above-referenced worm gear to convert linear movement into axial movement. In this example, the wedge 226 applies a force to a mating wedge 230, which drives axial movement of a tree stab 232 along an annulus axis 234. In the embodiment shown in FIG. 2, the wedge 226 and the mating wedge 230 are fully engaged, thereby driving the tree stab 232 along the annulus axis 234 in a downward direction.

In this example, the manual actuator 222 is coupled to a port 236 formed along the XT 202. This port 236 includes a passage 238 with a first end 240 and a second end 242. In a disengaged position (not shown) the wedge 226 may be closer to the first end 240 and out of contact with the mating wedge 230. Additionally, in embodiments, the wedge 226 may be slightly or partially in contact with the mating wedge 230. However, upon activation, the wedge 226 may move along the passage 238 from the first end 240 to the second end 242. As the wedge 226 moves, a wedge slant 244 contacts a mating wedge slant 246, thereby driving the tree stab 232 in the axial direction responsive to the force of the wedge 226. In this manner, the linear movement (e.g., radially inward toward the bore 208) may be converted into axial movement along the annulus axis 234. It should be appreciated that various angles of the slants 244, 246 may be particularly selected based on design conditions. For example, the angles may be adjusted to permit greater force transfer. Furthermore, in embodiments, one or more stops or other features may be incorporated to stop movement at a predetermined position. Additionally, as noted above, the wedges 226, 230 are shown as illustrative and are not intended to limit the scope of the present disclosure, as a variety of components may be utilized to translate a radial movement into an axial movement, including, but not limited to, worm gears, bevel gears, a rack and pinion, and the like.

The illustrated first component set 218 also includes a spring 248 positioned between the mating wedge 230 and the tree stab 232. The spring 248 may be utilized to transmit the force from the mating wedge 230 to the tree stab 232, for example, upon sufficient compression. As will be appreciated, the spring 248 may be positioned along the annulus flow path 214 in a manner that does not impede flow. It should be appreciated that various components have been removed for simplicity, such as seals, fasteners, and the like.

The AID 216 also includes the second component set 220, which is formed within the tubing hanger 206. It should be appreciated that, in various embodiments, components from each of the sets 218, 220 may move or be driven into the opposing part. For example, upon movement of the tree stab 232, the tree stab 232 may extend into the tubing hanger 206. Furthermore, in certain embodiments, the tree stab 232 may initially be landed within the tubing hanger 206 and may serve as a guide for landing the XT 202. The example second component set 220 includes a hanger stab 250 with a slotted portion 252. A spring 254 is also illustrated to apply a force to the hanger stab 250 responsive to movement and compression via the tree stab 232.

In operation, the tree stab 232 contacts the tubing hanger stab 250 at a mating interface 256 which drives movement of the tubing hanger stab 250 along the annulus axis 234. Accordingly, the slotted portion 252 may move into fluid communication with an annulus passage 258, thereby permitting flow into the annulus flow path 214. In this example, various components such as seals, fasteners, and the like have been removed for clarity. However, it should be appreciated that seals may be included and associated with at least the tubing hanger stab 250 to block flow through the annulus absent alignment between the slotted portion 252 and the passage 258.

Figure 3:
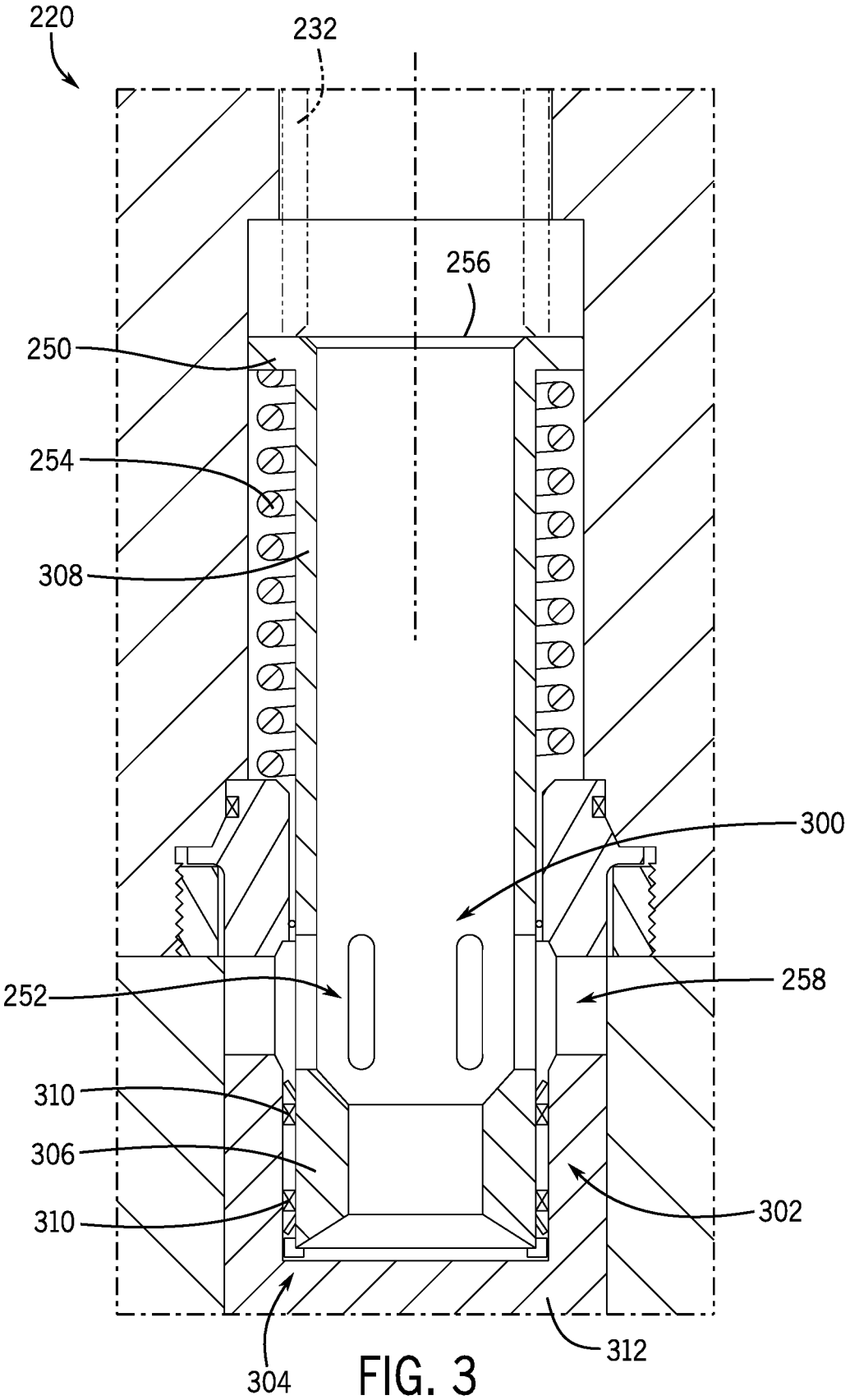
FIG. 3 is a schematic cross-sectional view of an embodiment of a wellbore system, in accordance with embodiments of the present disclosure.

FIG. 3 is a schematic cross-sectional view of a portion of the second component set 220, including the tubing hanger stab 250 and the slotted portion 252. The illustrated tubing hanger stab 250 is arranged such that the slotted portion 252 is aligned with the flow passage 258. Accordingly, fluid may enter the flow path (e.g., via the bore extending through the stabs 232, 250). In this example, a plurality of slots 300 are illustrated at the slotted section 252. It should be appreciated that any reasonable number of slots 300 may be utilized and that the size of the slots 300 may be particularly selected based on operating conditions.

In this example, the tubing hanger stab 250 includes a bottom portion 302 that includes a reinforced area 304. The reinforced area includes a thicker wall 306 than an adjacent wall 308 above the slots 300. The bottom portion 302 may be utilized to seal the passage 258, for example when the tubing hanger stab 250 is not activated via the tree stab 232. In other words, prior to activation, the bottom portion 302 may be aligned with the passage 258, rather than the slotted portion 252 shown in FIG. 3. For example, when the force from the tree stab 232 is removed, the spring 254 may drive the hanger stab 250 in an axially upward direction (e.g., axially upward and away from the annulus passage 258), thereby aligning the bottom portion 302 with the annulus passage 258. Accordingly, flow into the annulus flow path 214 may be blocked.

As shown, the bottom portion 302 includes seals 310, which may include elastomer seals and/or metal-to-metal seals. The seals may be positioned such that they are above and below the passage 258 when the bottom portion 302 blocks the passage 258. The example of FIG. 3 also illustrates a cap 312, which may be coupled to the tubing hanger 206 to receive the tubing hanger stab 256. In this example, the cap 312 includes the annulus passage 258. Accordingly, various embodiments may permit selection of different caps 312 to adjust an annulus passage size based, at least in part, on various operating conditions.

As described above, embodiments of the present disclosure may include the AID 216 for provision of a barrier or permitting flow into the annulus flow path 214. The AID 216 may include the stabs 232, 250, where the tree stab 232 is positioned, at least partially, within the XT 202 and the tubing hanger stab 250 is positioned, at least partially, within the tubing hanger 206. In operation, the manual actuator 222 drives the wedge 226 into the mating wedge 230, which axially moves the tree stab 232 in a downward direction, applying a force to the hanger stab 250 to axially move the slots 300 into alignment with the annulus passage 258. Accordingly, fluid may enter the annulus flow path 214. Prior to tree removal, the manual actuator 222 may be engaged to reverse a direction of the wedge 226, which may remove the force on the stabs 232, 250, thereby moving the slots 300 out of alignment with the passage 258 and moving the bottom portion 302 into alignment with the passage 258, thereby providing a barrier into the annulus flow path 214.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellbore system, comprising:

a tubing hanger positioned within a wellhead;

a Christmas tree (XT) coupled to the tubing hanger; and an annulus isolation device (AID) associated with the tubing hanger, wherein at least a portion of the AID extends through the XT and at least a portion extends through the tubing hanger, the AID comprising:

a manual actuator configured to drive a wedge in a linear direction;

a mating wedge arranged within an annulus flow path, the mating wedge configured to receive a force responsive to movement of the wedge; and a stab coupled to the mating wedge, the stab configured to move in an axially downward direction responsive to movement of the mating wedge, the stab having a slotted portion moveable into alignment with an annulus passage formed in the tubing hanger to permit flow into the annulus flow path.

2. The wellbore system of claim 1, wherein the stab comprises:

a tree stab; and a tubing hanger stab;

wherein the tree stab engages the tubing hanger stab at a mating interface and the slotted portion is formed in the tubing hanger stab.

3. The wellbore system of claim 1, wherein the stab comprises:

a bottom portion arranged axially lower than the slotted portion, the bottom portion having a reinforced wall section, wherein the bottom portion, when aligned with the annulus passage, is configured to block flow into the annulus flow path.

4. The wellbore system of claim 3, further comprising:

a first seal positioned axially above the bottom portion; and a second seal positioned axially below the bottom portion;

wherein the first seal is arranged axially above an opening of the annulus passage and the second seal is arranged axially below the opening of the annulus passage when the bottom portion is positioned to block flow into the annulus flow path.

5. The wellbore system of claim 1, wherein the manual actuator includes at least one of a worm gear, a bevel gear, a power gear, or a rack and pinon.

6. The wellbore system of claim 1, wherein the manual actuator includes an interface to be engaged by a remotely operated vehicle when the manual actuator is positioned in a subsea environment.

7. The wellbore system of claim 1, further comprising:

a cap coupled to the tubing hanger, the cap having the annulus passage.

8. The wellbore system of claim 1, further comprising:

a spring associated with the stab, the spring configured to provide an opposing force in an upward direction responsive to movement from the mating wedge.

9. The wellbore system of claim 8, wherein the spring is configured to drive the stab in a position where the slotted portion is out of alignment with the annulus passage.

10. A wellbore system, comprising:

a tubing hanger positioned within a wellhead;

a Christmas tree (XT) coupled to the tubing hanger; and an annulus isolation device (AID) associated with the tubing hanger, wherein at least a portion of the AID extends through the XT and at least a portion extends through the tubing hanger, the AID comprising:

an activation system, the activation system configured to convert a linear force into an axial force;

a first stab portion extending through at least a portion of the XT;

a second stab portion extending through at least a portion of the tubing hanger, the second stab portion including at least one opening fluidly coupled to an internal bore; and a cap positioned within the tubing hanger, the cap having an annulus passage to fluidly couple an annulus to an annulus flow path extending through the XT and the tubing hanger.

11. The wellbore system of claim 10, wherein the second stab portion comprises:

a bottom portion arranged axially lower than the opening, the bottom portion having a reinforced wall section.

12. The wellbore system of claim 11, further comprising:

a set of seals positioned along the bottom portion, the seals being arranged such that, when the bottom portion is aligned with the annulus passage, a first seal of the set of seals is axially higher than the annulus passage and a second seal of the set of seals is axially lower than the annulus passage.

13. The wellbore system of claim 10, wherein the activation system comprises:

an actuator;

a first wedge positioned along a linear passage, the actuator driving the first wedge along the linear passage; and a mating wedge arranged within the annulus flow path, the mating wedge receiving the axial force from the first wedge, as the first wedge is driven along the linear passage, wherein the mating wedge, responsive to the axial force, is configured to move along the annulus flow path.

14. The wellbore system of claim 13, wherein the mating wedge is maintained in a second position, after movement via the axial force, until the first wedge is moved in an opposite direction along the linear passage.

15. The wellbore system of claim 10, wherein the activation system is manually operated by a remotely operated vehicle.

16. The wellbore system of claim 10, wherein the first stab portion is positioned to engage the second stab portion at an interface responsive to the axial force.

17. A method, comprising:

positioning a stab within both a Christmas Tree (XT) and a tubing hanger;

applying a linear force to at least a portion of the stab;

causing the linear force to be converted into an axial force to drive the stab in a downward direction; and moving, responsive to the axial force, a slotted portion of the stab into alignment with an annulus flow passage, wherein the slotted portion is fluidly coupled to an annulus flow path extending through the stab.

18. The method of claim 17, further comprising:

removing the linear force from at least the portion of the stab; and causing the stab to move in an upward direction such that the slotted portion is moved out of alignment with the annulus flow passage.

19. The method of claim 17, wherein the linear force is applied via a manual actuator engaged by a remotely operated vehicle.

20. The method of claim 17, further comprising:

coupling, to the tubing hanger, a cap having the annulus flow path.

* * * * *